US005192373A

United States Patent [19]

Wright et al.

[11] Patent Number: 5,192,373

[45] Date of Patent: Mar. 9, 1993

[54] MAGNESIUM OXIDE COATING FOR ELECTRICAL STEELS AND THE METHOD OF COATING

[75] Inventors: Wade S. Wright, Fairfield; Robin A. Murphy, Franklin, both of Ohio

[73] Assignee: Armco, Inc., Middletown, Ohio

[21] Appl. No.: 686,019

[22] Filed: Apr. 12, 1991

Related U.S. Application Data

[62] Division of Ser. No. 404,714, Sep. 8, 1989, abandoned.

[51] Int. Cl.[5] ..... H01F 1/04

[52] U.S. Cl. ..... 148/113; 148/27; 148/28

[58] Field of Search ..... 148/111, 112, 113, 27, 148/28

[56] References Cited

U.S. PATENT DOCUMENTS

| | | | |
|---|---|---|---|
| 3,331,713 | 7/1967 | Miller | 148/113 |
| 3,697,322 | 10/1972 | Lee et al. | 148/113 |
| 4,344,802 | 8/1982 | Haselkorn | 148/27 |
| 4,443,425 | 4/1984 | Sopp et al. | 423/635 |
| 4,740,251 | 4/1988 | Howe | 148/6.14 R |
| 4,875,947 | 10/1989 | Nakayama et al. | 148/113 |

*Primary Examiner*—John P. Sheehan

*Attorney, Agent, or Firm*—Larry A. Fillnow; Robert J. Bunyard; Robert H. Johnson

[57] ABSTRACT

Decarburized grain oriented silicon steel is provided with an annealing separator which forms a glass film after the final high temperature anneal. The magnesia used as the annealing separator has a total chlorine level of 0.01 to 0.20% by weight based on the weight of magnesia with at least 0.01% metal chloride selected from the group of Mg, Ca, Na and K. The chloride addition acts to seal the coating surface during the final anneal to control diffusion and stabilize the secondary grain growth. The glass film which forms during the anneal may be laser scribed for domain refinement without coating damage. The magnesia may also contain additions of phosphates, $TiO_2$, $SiO_2$, Cr and B. The temperature of the magnesia is maintained below 25° C. to control hydration and eliminate the need for other additives in the magnesia slurry to control hydration.

21 Claims, No Drawings

MAGNESIUM OXIDE COATING FOR ELECTRICAL STEELS AND THE METHOD OF COATING

This is a divisional of copending application Ser. No. 07/404,714 filed on Sep. 8, 1989 now abandoned.

BACKGROUND OF THE INVENTION

The present invention relates to a coating composition which provides good insulative properties and acts an annealing separator during the final high temperature anneal for grain oriented electrical steels. Magnesia is used extensively as a separator for high temperature annealing of electrical steels after cold rolling. The coating is normally applied after decarburizing and forms a glass film during the final high temperature anneal.

DESCRIPTION OF THE PRIOR ART

Magnesia coatings which are composed mainly of magnesium oxide and magnesium hydroxide, are used extensively as a separator coating on electrical steel during the high temperature anneal to prevent the coil laps from sticking. A glass film forms from a reaction between the steel surface and the magnesia. A magnesia coating must possess certain physical qualities and also improve the overall magnetic qualities of the electrical steel. To provide all of these properties, the prior workers have done extensive modification to the basic magnesia composition.

Magnesium oxides when present with water can hydrate to magnesium hydroxide in a short period of time. The degree of hydration has a strong influence on the viscosity of the magnesia slurry and the control of the process for applying the coating. The amount of water in the coating can have an adverse effect on the glass film formation. To control hydration, prior workers have changed the size and distribution of the magnesia particles. They have adjusted the calcining temperatures for magnesia production. U.S. Pat. No. 4,168,189 (Haselkorn) is representative of this work.

Far more work has been done with additives to the magnesia to improve the glass film formation. A thin insulative glass film requires a reaction at elevated temperatures between the magnesia and the oxide film on the surface of the silicon steel after decarburization. Various silica and silicate compounds have been added to improve the reactions. Oxides of titanium, chromium and manganese have been added to improve the adherence and glass film. Phosphate additions have been taught to act as binders in the coating and improve hygroscopicity. Various coating additives are used to improve the appearance, thickness, oxidation resistance and other properties of the glass film produced during the high temperature anneal.

Considerable work has also been done to improve the magnetic properties of the silicon steel by adjusting the composition of the magnesia. The magnesia has a strong influence on surface reactions relating to atmosphere interactions and grain size control. U.S. Pat. No. 3,627,594 adds titanium dioxide and manganese oxides. U.S. Pat. No. 3,676,227 adds boron compounds to the magnesia.

Chlorides have been added to magnesias in the past but in combination with other compounds. U.S. Pat. No. 4,543,134 adds a chloride of Sb, Sr, Ti or Zr with an antimony compound, such as $Sb_2(SO_4)_3$, to seal the strip surface and prevent the atmosphere from reacting with the base metal. The chlorides are used to increase the silica formed on the surface and reduce the FeO content. The sealing function of the magnesia coating is attributed to the antimony compound which prevents the removal and absorption of the inhibitor elements. The level of chlorine in the coating may range from 0.0025 to 0.4%.

U.S. Pat. No. 3,841,925 adds a chlorine contributor and sodium metasilicate to magnesia to resist hydration and form a nonporous insulative coating. The critical balance between these additions results in a magnesia with sodium chloride and magnesium silicate which delay hydration and provide a longer residence time for coating. The magnesia has a high level of chlorine, typically about 0.22 to 3.4% based on the weight of magnesia.

U.S. Pat. No. 4,287,006 in FIG. 1 clearly shows the importance of eliminating chlorine by requiring the temperature of calcining to be above 1300° C. for the control of hydration of magnesias. Column 7, line 27 of this patent states the annealing separator should contain no magnesium chloride or magnesium sulfate because they hinder the formation of the glass film.

U.S. Pat. No. 3,956,029 states chlorine should be below 0.04% in magnesia coatings because it forms a corrosive gas which attacks the base metal and causes a rough surface. The irregular coating thickness which results causes a poor glass film with subsequent peeling problems.

U.S. Pat. No. 3,941,623 teaches the control of the moisture which remains from the hydration of magnesium oxide during the final high temperature anneal. The patent uses metal nitrides which are subsequently converted into oxides during the anneal to consume water and lower the dew point. This reduces the steel oxides and provides an improved glass film and grain growth control in the (110)[001] direction.

Magnesium oxides used for annealing separators in processing electrical steels during the final anneal at temperatures between 1100° C. and 1300° C. have been modified in many ways. The problems of hydration control, glass film-metal surface reactions, impurity removal at the surface and excellent magnetic properties in the glass film and base metal have been so complex that the solutions have been only partially successful. The additions to magnesia in the past have also been very complex in nature due to the interactions with other additives.

The present invention has provided magnesia additives used for annealing separators which do not cause an unsafe environmental working condition and which are less expensive to use. The interactions with the magnesia components are less complex but still provide the desired benefits of a high quality glass film and excellent improvements to magnetic quality. The additives are carefully controlled within critical limits to provide the desired combination of properties.

SUMMARY OF THE INVENTION

The present invention has discovered the addition of a metal chloride (selected from the group of Mg, Na, K and Ca) to magnesia will provide improved orientation and magnetic quality without the combined addition of sodium metasilicate or antimony sulfate. The level of chlorine from the chloride addition within the range of 0.01 to 0.2% was found to produce excellent glass film quality and magnetic improvements at least as good as prior art magnesias but without the environmental concerns of antimony. The chloride addition of the present invention lowers the glass film formation temperature to seal the surface at a lower temperature. The control of coating porosity using chlorides without the need for another additive which reacts with the chlorine is unexpected based on prior work with chlorides. The chloride addition provides an improved control of final grain orientation and grain size by limiting the diffusion and surface interactions. The use of Mg, Ca, Na and/or K to provide the source of chlorine is also critical to the quality of the glass film and the magnetic properties of the electrical steel strip. It is important to note that the total level of chlorine in the magnesia must be considered to optimize the level of metal chloride being added. The production of the magnesia may inherently have some level of chlorine which may be adjusted in combination with the metal chloride addition.

The magnesias of the present invention may also contain additions of titanium dioxide to stabilize the aqueous suspension and improve the glass film quality and the magnetic properties of the steel strip. Boron, chromium, silica and calcium phosphate additions are also optional with the present coating composition. The magnesias of the present invention may also be modified to optimize the benefits for regular grain oriented or high permeability grain oriented.

The present invention also provides a process for coating silicon containing electrical steel strip with an adherent electrically insulative coating prior to the final high temperature anneal. The aqueous slurry of magnesia is conventionally applied to the decarburized strip, heated to remove water and dry the coating and annealed above about 1,000° C. to form a glass film and develop the desired magnetic properties.

DETAILED DESCRIPTION OF THE INVENTION

The annealing separator of the present invention is a magnesia with a controlled level of hydration to allow the aqueous slurry to be applied by conventional processing. Magnesia slurries will have some degree of hydration which require the water of hydration to be driven off during the high temperature anneal. The water remaining after drying will cause porosity in the final glass. To provide a magnesia slurry with controlled hydration, the majority of the particles should have a citric acid activity (CAA) below 200 and preferably below 100. CAA is a measure of the activity of the magnesia determined by the time required for a predetermined amount of hydroxyl ions to neutralize a given weight of citric acid. The test is disclosed fully in U.S. Pat. No. 3,841,925 at lines 22–46 of column 4. The magnesias of the present invention may also include up to about 45% inactive magnesia which has a CAA above 200 and typically about 500–5,000. The inactive magnesia tends to control hydration since it hydrates more slowly and also is less expensive. The amount of inactive magnesia which can be effectively used is related to the quality of the glass film and the control of porosity in the film.

The magnesia of the present invention requires a chlorine addition within the critical range of 0.01 to 0.20 weight % to provide good glass film formation and improved magnetic quality in the grain oriented electrical steel. The chlorine level required may be partially provided by the magnesia production in combination with at least 0.01% metal chloride. It is the total level of chlorine present which must be controlled within the ranges of 0.01 to 0.20%.

The chlorine in a metal compound selected from the group of Mg, Na, K and Ca may be added to the magnesia in an amount of 0.01 to 0.20 weight % based on the weight of MgO depending on the level of chlorine present in the magnesia initially. The metals used with the chlorides are selected to provide improved magnetic quality without any adverse effects on safety, cost and glass film and may be used alone or in combination. The magnesia of the present invention will have a citric acid activity of less than 200 for the majority of the particles. The magnesia may also contain up to about 45% inactive magnesia particles having a citric acid activity above 200 and typically from above 500 to 5,000.

The magnesia coating of the present invention is applied to cold rolled strip of electrical steel prior to the final high temperature anneal. The electrical steel strip is typically grain oriented silicon steel containing up to 4% silicon, up to 0.08% carbon, and any of the well known grain growth inhibitors, such as AlN, MnS, MnSe, BN, and others. High permeability silicon steel is generally considered to possess a permeability above 1880 at 796 A/m and has an aluminum nitride inhibitor system as a result of adding about 0.01 to 0.065% aluminum. U.S. Pat. No. 3,676,227 is typical of this technology. Decarburization of the strip produces a carbon level below about 0.003% and a surface oxide which reacts with the magnesia during the final high temperature anneal to form the glass film of forsterite. The oxide film formed during decarburizing is basically fayalite and $SiO_2$ with some iron oxide present.

The chloride addition of the present invention modifies the surface reactions and the level must be carefully controlled. Total chlorine levels above 0.20% produce a glass film with too high a level of iron to be acceptable quality. Excessive chlorine levels also result in poor oxidation resistance and poor surface resistivity due to the iron content on the surface. The interface between the glass film and the base metal also becomes too rough with high levels of chlorine. Chlorine is preferably added at levels below about 0.15% and more preferably below about 0.12%. To obtain the magnetic improvement to the electrical steel, a minimum level of 0.01% chlorine must be present. A preferred minimum chlorine added as a metal chloride of the invention is about 0.015% (and more preferably 0.02%) which provides an optimum balance between improving the glass film and the magnetic properties of the base metal.

The chlorides of the present invention act to seal the surface during annealing to control the gain growth inhibitors. This plays a major role in the stability of secondary grain growth. In prior chloride additions to magnesia, such as U.S. Pat. No. 3,841,925, the formation of a nonporous coating was provided by the reaction with a compound such as sodium metasilicate which was balanced stoichiometrically to the chlorides. The reaction produced magnesium silicate and sodium chloride which formed the nonporous coating and controlled hydration. Examples with magnesium chlorides within the ranges of the present invention were shown to be unsuitable for coating (viscosity so low that the slurry was too thin and resulted in excessive porosity). The work done in this patent clearly shows a quantity of sodium silicate less than the stoichiometric equivalent to react with magnesium chloride will produce a coating which is deficient in insulative properties and is porous. The present invention has found that a critical lower level of chlorine does not require the sodium silicate addition.

The other prior work of interest was the addition of Sb, Sr, Ti or Zr chloride with antimony sulfate in U.S. Pat. No. 4,543,134. The chlorine was selected in an amount from 0.0025 to 0.4%. With less than 0.05% antimony sulfate, the patent taught magnetic properties would not be improved. The present invention provides the same improvements without the antimony sulfate addition which this patent taught was required. The present invention also uses different metals to provide the addition of the chlorine.

In order to apply the magnesia of the present invention by conventional means, the hydration of the magnesia must be controlled to provide a slurry having a viscosity within a workable range and a stability sufficient to provide a reasonable range of operation. This is accomplished by controlling the temperature of the magnesia slurry, the particle size of the magnesia and the use of various additives.

The temperature of the magnesia is controlled to be above freezing and below about 75° F. (25° C.) and preferably between about 32°-45° F. (0°-7° C.). This eliminates the need for additional additives for hydration control which may have an adverse influence on glass film quality or the magnetic properties of the silicon steel. To maintain the temperature range of the slurry, the magnesia is maintained in an insulated vessel with refrigeration coils. The magnesia is mixed with cold water and never stored for prolonged periods of time. By maintaining this cold condition of the magnesia, the slurry does not hydrate to a significant degree which would interfere with the coating thickness or uniformity of the glass film. The temperature of the magnesia has a general relationship to the storage life before hydration adversely affects the application of the coating. The higher the temperature, the more quickly it must be used.

The particle size and citric acid activity of the magnesia for high permeability silicon steel plays an important role in the glass film quality. The majority of the particles will have a CAA below 200 and preferably below 100. The magnesia may contain up to about 45% inactive magnesia which has a CAA above 200 and typically from 500 to 5,000. Regular grain oriented silicon steel may use a magnesia with larger particle size and have more inactive magnesia. The bulk density or packing factor of the dried magnesia coating is dependent on the particle size distribution and CAA to control the interactions with the atmosphere and surface reactions on the steel. The degree of hydration will also influence the magnesia particles during drying. The amount of water of hydration will be reduced with larger particle sizes. Too coarse of particles will tend to settle out of the slurry and not undergo reaction with the silica during the final anneal. To avoid having a porous coating due to excess hydration and have a magnesia which may be applied as an aqueous slurry by dipping, spraying or metering rolls, all of these variables must be controlled. The magnesia coatings of the invention will produce a good glass film under these conditions and will eliminate the need for the sulfate and silicate additions required in prior coatings.

The chloride addition has another important consideration which has not been addressed in the prior art. Laser scribing for domain refinement has become a required practice for high permeability grain oriented silicon steel. The nature of the surface film has a considerable influence on the amount of energy from the laser which passes through the glass film and the amount of damage caused to the glass film during domain refinement. The present glass film developed by the chloride additions of the present invention is controlled to provide a glass film which may be laser treated without surface damage. A laser process such as taught in U.S. Pat. No. 4,456,812 has been found to be very beneficial in providing domain refinement without damage to the glass film.

To evaluate the properties of glass film produced from a magnesia having a chlorine addition using a compound of the invention, a series of experiments were conducted. Cold rolled strip of high permeability silicon steel having an AlN inhibitor system was coated with a magnesia having $MgCl_2$ of various amounts. The results were compared to a magnesia having an addition of antimony sulfate as described in U.S. Pat. No. 4,543,134 and are shown in TABLE 1. The material was 0.23 mm in thickness, 76 mm in width and 305 mm in length. The results are the average of 10 samples coated with TATEHO A1120 magnesia, manufactured by TATEHO CHEMICAL INDUSTRIES CO., LTD A1120 magnesia with 5% $TiO_2$. The samples were heated up to 1200° C. in a 25% nitrogen-75% hydrogen atmosphere with a 4° C. dew point. The samples were soaked at 1200° C. for 15 hours in 100% $H_2$. After the final anneal was completed, the samples were scrubbed and stress relief annealed. The magnesia used had a chlorine level of 0.02 weight %.

TABLE 1

| ADDITIVE | TOTAL % Cl WEIGHT % | 15 KG WATTS/LB CORE LOSS | 17 KG WATTS/LB CORE LOSS | H-10 PERM |
|---|---|---|---|---|
| — | 0.02 | .397 | .566 | 1925 |
| $Sb_2(SO_4)_3$ + $SbCl_3$ | 0.035 | .392 | .549 | 1938 |
| $Sb_2(SO_4)_3$ + $SbCl_3$ | 0.065 | .389 | .531 | 1939 |
| $Sb_2(SO_4)_3$ + $SbCl_3$ | 0.095 | .396 | .561 | 1931 |
| — | 0.02 | .397 | .566 | 1925 |
| $MgCl_2$ | 0.035 | .392 | .548 | 1927 |
| " | 0.065 | .398 | .547 | 1940 |
| " | 0.095 | .393 | .533 | 1941 |

A comparison of the magnetic properties between the 2 additives to the magnesias indicate the magnesium chloride addition which adds about 0.015 to 0.075% chlorine produces magnetic properties equal to or better than the same level of chloride addition with the antimony sulfate within the range of about 0.03 to 0.10% total chlorine. It is clearly suggested that levels of chlorine up to 0.20% should produce better magnetic properties with the magnesium chloride addition of the present invention based on the trend up to the 0.10% level. The higher the chlorine level, the more the magnesium chloride is preferred over the Sb chloride additives.

As part of the investigation, other samples were also evaluated for glass film quality using comparative evaluations on secondary coating adherence, oxidation resistance and Franklin resistivity measurements on the glass film. These results are shown in TABLE 2.

TABLE 2

| PHYSICAL GLASS FILM QUALITY | | | |
|---|---|---|---|
| Total % Cl | Oxidation Resistance | % Secondary Coating Flaking | Franklin Amps Glass Film |
| 0.011 | Good | Fair | .506 |
| 0.031 | Very Good | Very Good | .587 |
| 0.061 | Fair | Very Good | .665 |
| 0.111 | Poor | Best | .755 |

All chloride additions are $MgCL_2$. MgO has 0.011% Cl
All coating weights are about 6.4 $gm/m^2$/side
0.23 mm High Permeability Silicon Steel A preferred level of total chlorine has been determined to be about 0.015 to about 0.15%. A more preferred total level of chlorine is about 0.015 to about 0.12%, which provides a good balance of magnetic improvements with a glass film having good physical properties. The optimum total chlorine level appears to be from 0.02 to 0.10%.

The resulting glass film must also permit laser scribing without coating damage. The laser scribing process of U.S. Pat. No. 4,456,812 provides improved domain refinement with the present glass films and avoids coating damage. The magnesia composition of the present invention provides improved optical characteristics for laser treatments. While any of the metals selected from the group of Mg, Ca, K or Na may be used alone or in combination, the use of Mg and Na are preferred. The magnesia may include up to 15 weight % $TiO_2$ and preferably about 5 to 10% when added. Colloidal silica may also be added in amounts up to 10 weight %. For high permeability grain oriented silicon steel, the level of silica is preferably about 3 to 7% and boron is preferably about 0.05 to 0.15%. Chromium is also an optional addition up to 15 weight %. Preferably the level is restricted to about 2.5 to about 5% when added.

The magnesias of the present invention may also be used for insulative coatings for regular grain oriented electrical steels. These magnesias may be varied slightly to include up to about 20% phosphate additions with calcium phosphate additions preferred within the range of 4–15%, up to 15% chromium additions with 2–10% preferred, up to 10% silica with about 3–7% preferred and up to 0.15% boron with a preferred maximum of 0.10%.

The glass film formed from the magnesia may have an insulative coating applied over the surface and the secondary coating will have good adherence.

The addition of the metal chloride in the present invention does not require a precipitation reaction with a solution of a silicate salt as claimed in U.S. Pat. No. 3,941,622. A magnesia-silica complex is not applied in the process of the present invention. TABLE 3 below shows the influence of the metal chloride addition within the ranges of the invention for magnesium, calcium and sodium. The permeability and core losses are dramatically improved by adding these levels of chlorides. The results also indicate that increasing calcium to the more preferred level for magnesium and sodium does not provide any additional benefit and, in fact, may cause a slight degradation in properties. While no data is provided for potassium, it is expected to behave similar to sodium in the levels required to obtain similar benefits. Both sodium and potassium tend to smooth the metal interface. Magnesium tends to be more neutral in this regard. Calcium appears to improve adherence of the glass film. All of the metal chloride additives of the invention provide a level of chlorine which roughen the strip surface. As stated previously, the chlorine also lowers the temperature of glass film formation. It is important to note that magnesias may have an inherent level of chlorine, such as 0.011% in the first example of TABLE 3. This chlorine level must be considered as contributing to the total level of chlorine reacting in the system. The minimum metal chloride addition to provide 0.01% chlorine must be adhered to regardless of the chlorine content of the magnesia. Part of the preferred higher chlorine contents may include chlorine from the magnesia in combination with the metal chlorides.

TABLE 3

| CHLORIDE ADDITIVES | | | | | | |
|---|---|---|---|---|---|---|
| | | Stress Relief Annealed | | | Laser Scribed | |
| Additive | Total % Cl | W15/60 (w/kg) | W17/60 (w/kg) | B8 (T) | W15/60 (w/kg) | W17/60 (w/kg) |
| — | 0.011 | .901 | 1.258 | 1.914 | .835 | 1.141 |
| $MgCl_2$ | 0.041 | .881 | 1.231 | 1.925 | .802 | 1.081 |
| $MgCl_2$ | 0.071 | .872 | 1.218 | 1.927 | .793 | 1.070 |
| NaCl | 0.041 | .874 | 1.225 | 1.923 | .800 | 1.084 |
| NaCl | 0.071 | .874 | 1.203 | 1.932 | .786 | 1.048 |
| $CaCl_2$ | 0.041 | .881 | 1.231 | 1.923 | .802 | 1.084 |
| $CaCl_2$ | 0.071 | .894 | 1.242 | 1.927 | .804 | 1.079 |

Stress relief anneal at 1525° F., 2 hours, in 95% $N_2$-5% $H_2$

The levels of the metal chloride required to improve glass film and magnetic properties appear to vary slightly depending on the metal selected. The preferred maximum level of chlorine with calcium chloride appears to be lower than with magnesium, sodium or potassium chloride additions. While the reason for this difference is not completely understood, the improved properties occur with a preferred calcium addition of about 0.015–0.07%. The preferred levels with the other metal chloride additions of the invention is about 0.015–0.10%. These addition levels may be adjusted to compensate for the level of chlorine present in the source of magnesia.

The present invention has been described with reference to particular embodiments but is to be understood that numerous modifications may be made without departing from the scope of the invention. The appended claims are intended to cover all such equivalent variations as come within the true spirit and scope of the invention. All % in the claims are in weight % based on the weight of magnesia.

What is claimed is:

1. A method for producing a glass film on oriented silicon steel strip, said method comprising the steps of:

a) providing a magnesia bath consisting essentially of magnesia particles with a majority of said magnesia particles having a citric acid activity less than 200 seconds, up to 15 weight % $TiO_2$ based on the weight of said magnesia, up to 10 weight % $SiO_2$ based on the weight of said magnesia, up to 15 weight % Cr based on the weight of said magnesia, up to 0.3 weight % B based on the weight of said magnesia, up to 20 weight % phosphate based on the weight of said magnesia, and a metal chloride selected from the group consisting of magnesium chloride, calcium chloride, sodium chloride and/or potassium chloride:

b) maintaining said magnesia bath at temperature from above freezing to 25° C.;

c) applying an aqueous magnesia slurry from said bath to said strip;

d) drying said magnesia slurry to remove excess water and provide a dried magnesia coating weighing about 6.4 grams per square meter, said dried coating having 0.01 to 0.20 weight % total chlorine based on the weight of said dried magnesia with at least 0.01 weight % based on the weight of said dried magnesia being from said metal chloride; and e) providing a final high temperature anneal to form said glass film wherein said metal chloride seals said coating surface during said anneal to control grain growth inhibitors in said steel to stabilize secondary grain growth and develop improved magnetic properties.

2. The method of claim 1, wherein said chlorine weight from said metal chloride in said dried coating is 0.015 to 0.15 weight % based on the weight of said dried magnesia.

3. The method of claim 1, wherein said magnesia bath is maintained between 0° C. and 15° C.

4. The method of claim 1, wherein said magnesia particles include up to 45% inactive magnesia particles with a citric acid activity above 200 seconds.

5. The method of claim 1, wherein said magnesia particles include up to 45% inactive magnesia particles with a citric acid activity of 500 to 5,000 seconds.

6. The method of claim 1, wherein said total chlorine level is from 0.015 to 0.12 weight % chlorine based on the weight of said dried magnesia.

7. The method of claim 1, wherein said total chlorine level is from 0.02 to 0.10 weight % chlorine based on the weight of said dried magnesia.

8. The method of claim 1, wherein said total chlorine is from 0.015 to 0.10 weight % based on the weight of said dried magnesia and said metal chloride is selected from the group of Mg, Na and/or K chloride.

9. The method of claim 1, wherein said metal chloride is calcium chloride and is added in an amount to produce a total chlorine level of 0.015 to 0.07 weight % chlorine based on the weight of said dried magnesia.

10. The method of claim 1, wherein said steel strip is regular grain oriented silicon steel and said magnesia bath includes up to 0.15 weight % B based on the weight of said dried magnesia.

11. The method of claim 10, wherein said magnesia bath includes 4 to 15 weight % calcium phosphate based on the weight of said magnesia, 2 to 10 weight % Cr based on the weight of said magnesia, up to 0.10 weight % B based on the weight of said magnesia and 3 to 7 weight % $SiO_2$ based on the weight of said magnesia.

12. The method of claim 1, wherein said steel strip is high permeability grain oriented silicon steel and said magnesia bath includes 5 to 10 weight % $TiO_2$ based on the weight of said magnesia, 3 to 7 weight % $SiO_2$ based on the weight of said magnesia, 2.5 to 5 weight % Cr based on the weight of said magnesia and 0.05 to 0.15 weight % B based on the weight of said magnesia.

13. A method for providing a glass film on oriented silicon steel strip, said method comprising the steps of:

a) providing a magnesia bath consisting essentially of magnesia particles with a majority of said magnesia particles having a citric acid activity less than 200 seconds, up to 15 weight % $TiO_2$ based on the weight of said magnesia, up to 10 weight % $SiO_2$ based on the weight of said magnesia, up to 15 weight % Cr based on the weight of said magnesia, up to 0.3 weight % B based on the weight of said magnesia, up to 20 weight % phosphate based on the weight of said magnesia, and a metal chloride selected from the group consisting of magnesium chloride, calcium chloride, sodium chloride and/or potassium chloride;

b) maintaining said bath at a temperature from above freezing to 25° C.;

c) applying a magnesia slurry from said bath to said strip;

d) drying said magnesia slurry to remove excess water and provide a dried magnesia coating having from $1.8\times10^{-9}$ to $3.6\times10^{-8}$ moles chlorine per square centimeter per side of said steel with at least $1.8\times10^{-9}$ moles chlorine per square centimeter per side of said steel being provided by said metal chloride; and e) providing a final high temperature anneal to form said glass film wherein said metal chloride seals said coating surface during said anneal to control grain growth inhibitors in said steel to stabilize secondary grain growth and develop improved magnetic properties.

14. The method of claim 13 wherein said chlorine content is about $2.7\times10^{-9}$ to about $2.7\times10^{-8}$ moles chlorine per square centimeter per side of said steel.

15. The method of claim 13 wherein said chlorine content is about $2.7\times10^{-9}$ to about $2.2\times10^{-8}$ moles chlorine per square centimeter per side of said steel.

16. The method of claim 13 wherein said magnesia bath includes up to 0.15 weight % boron based on the weight of said magnesia and said strip is regular grain oriented steel.

17. The method of claim 16 wherein said magnesia bath includes 4 to 15 weight % calcium phosphate based on the weight of said magnesia, 2 to 10 weight % Cr based on the weight of said magnesia, up to 0.1 weight % B based on the weight of said magnesia and 3 to 7 weight % $SiO_2$ based on the weight of said magnesia.

18. The method of claim 13 wherein said magnesia bath includes 5 to 10 weight % $TiO_2$ based on the weight of said magnesia, 3 to 7 weight % $SiO_2$ based on the weight of said magnesia, 2.5 to 5 weight % Cr based on the weight of said magnesia, 0.05 to 0.15 weight % B based on the weight of said magnesia and said strip is high permeability grain oriented silicon steel.

19. The method of claim 13 wherein said dried magnesia coating is about 6.4 grams per square meter per side of said oriented silicon steel strip.

20. A method of improving glass film quality on a grain oriented silicon steel strip, said method comprising the steps of:

a) applying to said steel strip a magnesia slurry at a temperature below 25° C., said slurry consisting essentially of a majority of magnesia particles with a CAA below 200 seconds, up to 15 weight % $TiO_2$ based on the weight of said magnesia, up to 10 weight % $SiO_2$ based on the weight of said magnesia, up to 15 weight % Cr based on the weight of said magnesia, up to 0.3 weight % B based on the weight of said magnesia, up to 20 weight % phosphate based on the weight of said magnesia, and a metal chloride selected from the group consisting of magnesium chloride, calcium chloride, sodium chloride and/or potassium chloride;

b) heating said steel to drive off excess water and dry said slurry; and c) controlling chlorine content in said slurry to provide a dried magnesia coating having from $1.8\times10^{-9}$ to $3.6\times10^{-8}$ moles chlorine per square centimeter per side of said steel strip with at least $1.8 \times 10^{-9}$ moles chlorine per square centimeter per side being provided by said metal chloride and the balance from the magnesia;

d) providing a final high temperature anneal to form said glass film having improved optical properties for laser treatment wherein said metal chloride seals said coating surface during said anneal to control grain growth inhibitors in said steel, to stabilize secondary grain growth and develop improved magnetic properties.

21. The method of claim 20 wherein said dried magnesia coating has a weight of about 6.4 grams per square meter.

* * * * *